US008087747B2

(12) United States Patent
Mihara et al.

(10) Patent No.: US 8,087,747 B2
(45) Date of Patent: Jan. 3, 2012

(54) INK JET RECORDING HEAD UNIT AND PRODUCTION PROCESS THEREOF

(75) Inventors: Hiroaki Mihara, Machida (JP); Akihiko Shimomura, Yokohama (JP); Takashi Fukushima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 760 days.

(21) Appl. No.: 12/169,171

(22) Filed: Jul. 8, 2008

(65) Prior Publication Data

US 2009/0066771 A1 Mar. 12, 2009

(30) Foreign Application Priority Data

Jul. 10, 2007 (JP) ..... 2007-180795
May 12, 2008 (JP) ..... 2008-124927

(51) Int. Cl.
*B41J 2/135* (2006.01)

(52) U.S. Cl. ..... 347/45; 347/29

(58) Field of Classification Search ..... 347/29, 347/45

See application file for complete search history.

(56) References Cited

U.S. PATENT DOCUMENTS

| | | | | |
|---|---|---|---|---|
| 5,917,514 | A * | 6/1999 | Higuma et al. | 347/29 |
| 6,481,825 | B1 * | 11/2002 | Hinami et al. | 347/29 |
| 7,344,221 | B2 * | 3/2008 | Miyakawa et al. | 347/29 |
| 7,568,787 | B2 * | 8/2009 | McAvoy et al. | 347/54 |
| 7,600,857 | B2 * | 10/2009 | Kihara et al. | 347/56 |
| 7,665,822 | B2 * | 2/2010 | Aoki | 347/29 |
| 7,845,758 | B2 * | 12/2010 | Hayashi et al. | 347/29 |
| 7,850,285 | B2 * | 12/2010 | Yoshihira et al. | 347/65 |
| 2005/0078143 | A1 | 4/2005 | Shimomura et al. | |
| 2007/0139467 | A1 | 6/2007 | Kihara et al. | |

* cited by examiner

*Primary Examiner* — Charlie Peng
(74) *Attorney, Agent, or Firm* — Fitzpatrick, Cella, Harper & Scinto

(57) ABSTRACT

In an ink jet recording head unit, on a surface of an ejection outlet surface of an ink jet recording head, a tape is applied so that a portion of the tape with a relatively high adhesiveness corresponds to an area of the ejection outlet surface with a relatively high hydrophobicity and a portion of the tape with a relatively low adhesiveness corresponds to an area of the ejection outlet surface with a relatively low hydrophobicity.

13 Claims, 10 Drawing Sheets

INK JET RECORDING HEAD UNIT AND PRODUCTION PROCESS THEREOF

FIELD OF THE INVENTION AND RELATED ART

The present invention relates to an ink jet recording head unit used in an ink jet recording method in which recording is effected by ejecting ink from an ink jet recording head.

As an ejection outlet protecting method for protecting ejection outlets of an ink jet recording head used in an ink jet print method during transportation, a method in which the ejection outlets are sealed with a sealing tape or the like method may be employed. The sealing tape may include, e.g., an adhesive tape and a hot-melt tape.

As a technique using such an ejection outlet protecting method, e.g., Japanese Patent No. 5917514 discloses a sealing member for an ink accommodating portion. This sealing member for the ink accommodating portion prevents ink from leaking from the ejection outlets by using a sealing tape having a load in a predetermined range when the sealing tape for protecting the ejection outlets is separated.

In the ink jet recording head, in order that the ink is not present in the neighborhood of the ejection outlets, on an ejection outlet surface provided with the ejection outlets (hereinafter referred to as an "orifice surface"), a hydrophobic area is formed in the neighborhood of the ejection outlets and a hydrophilic area is formed in an area apart from the ejection outlets is some cases. In these cases, the hydrophobic area can be located in the neighborhood of the ejection outlets and the hydrophilic area can be located at an outer peripheral portion of the hydrophobic area or can be surrounded by the hydrophobic area.

Here, the "hydrophobic area" means an area in which a hydrophobicity is relatively large on the orifice surface and the "hydrophilic area" means an area in which the hydrophobicity is relatively small on the orifice surface.

In the hydrophilic area, compared with the hydrophobic area, an adhesive material constituting an adhesive layer is liable to be applied to the hydrophilic area. For this reason, when the sealing tape is separated, even in the case where the adhesive material of the sealing tape does not remain in the hydrophobic area, there is a possibility that a part of the adhesive layer is separated due to excessive adherence of the adhesive layer in the hydrophilic area to leave the adhesive material in the hydrophilic area.

When the adhesive material remains in the hydrophilic area, during cleaning of the orifice surface of the ink jet recording head by wiping or the like by an ink jet recording apparatus, there is an increasing possibility of an occurrence of ejection failure due to clogging of the ejection outlets with the adhesive material remaining in the hydrophilic area during the wiping.

SUMMARY OF THE INVENTION

A principal object of the present invention is to provide an ink jet recording head unit capable of alleviating the above-described remaining phenomenon of an adhesive material.

Another object of the present invention is to provide a process for producing the ink jet recording head unit.

According to an embodiment of the present invention, in an ink jet recording head unit provided with a tape applied to an ejection outlet surface having an area with a relatively high hydrophobicity and an area with a relatively low hydrophobicity, the remaining phenomenon of an adhesive material on the ejection outlet surface can be alleviated by applying a portion of the tape with a relatively high adhesiveness to the relatively high hydrophobic area and applying a portion of the tape with a relatively low adhesiveness to the relatively low hydrophobic area.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of the present invention will be described hereinbelow with reference to the drawings.

Figure 1A:
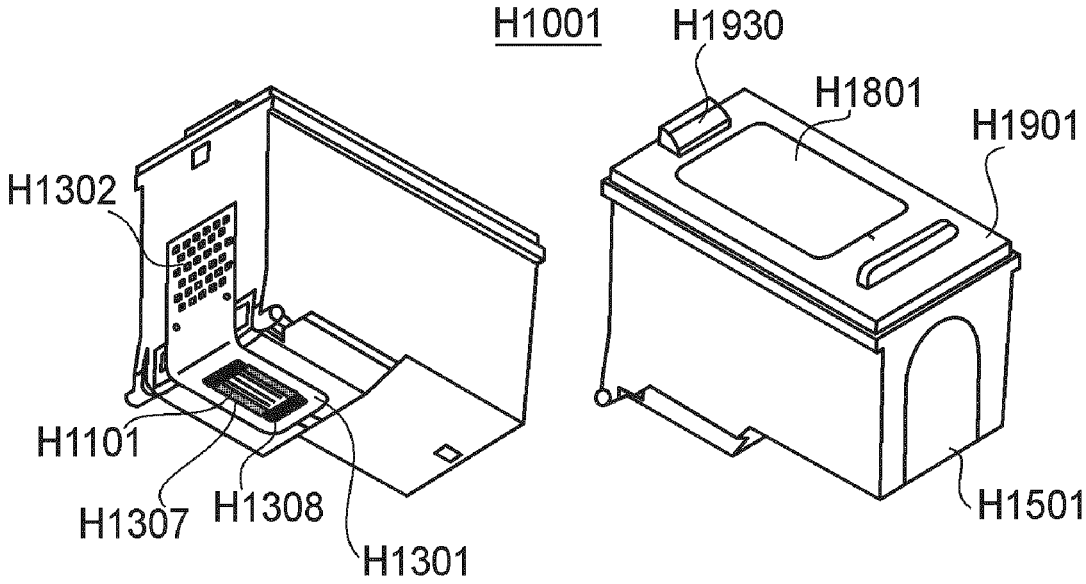
FIG. 1A includes perspective views showing an ordinary ink jet recording head to which the present invention is applicable, and FIG. 1B includes perspective views showing an ink jet recording head unit including the ink jet recording head shown in FIG. 1A and a sealing tape applied to the ink jet recording head.
Figure 1B:
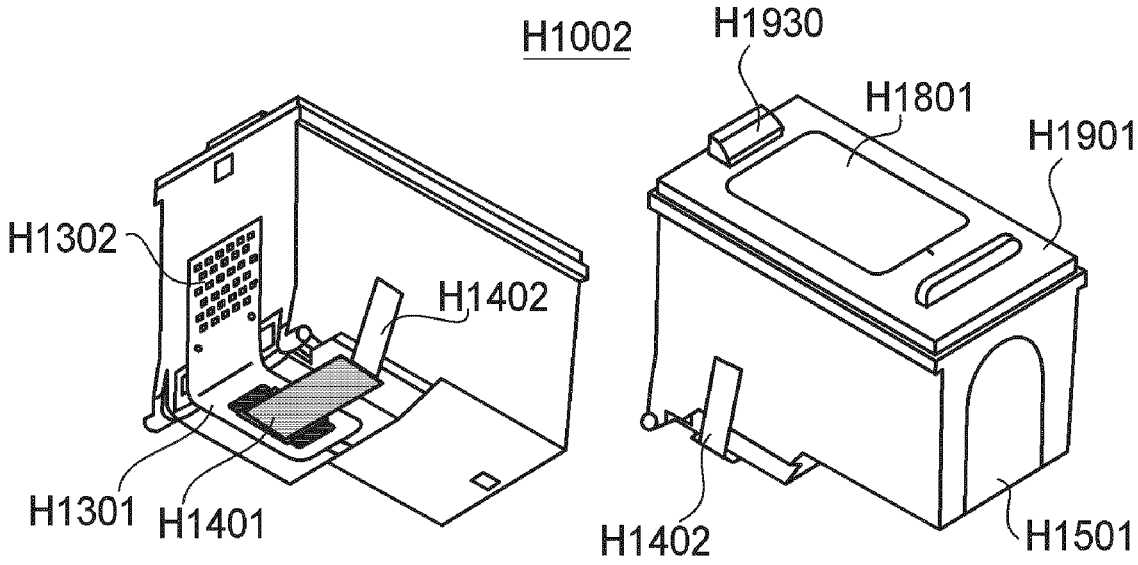
Figure 2:
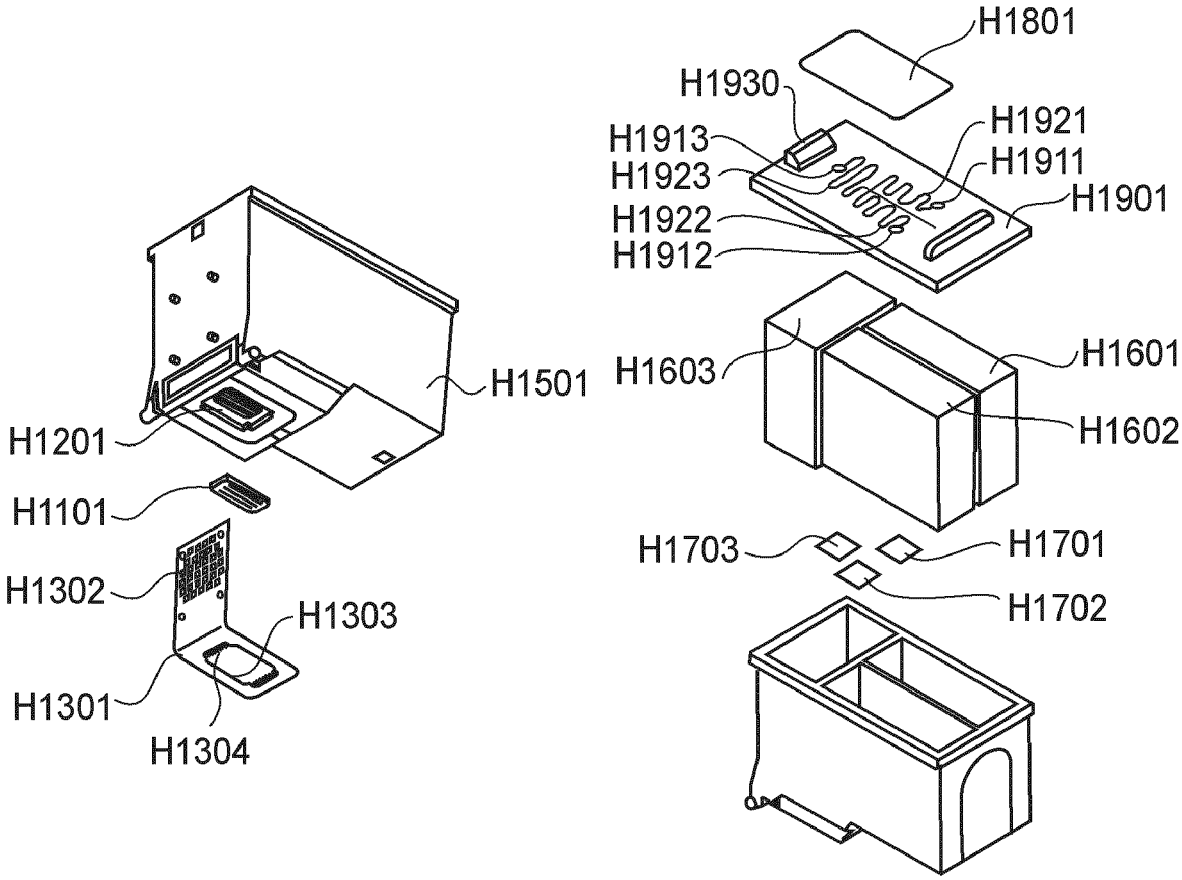
FIG. 2 includes exploded perspective views showing a structure of the ink jet recording head shown in FIG. 1A.

With reference to FIGS. 1A, 1B and 2, a structure of an ink jet recording head to which the present invention is applicable will be described.

Referring to FIG. 1A, an ink jet recording head H1001 is of an ink container integral tape in which ink is filled in the ink container. The ink jet recording head H1001 may also be an ink container separate type.

FIG. 1B shows an ink jet recording head unit H1002 in which a sealing tape H1401 for protecting and sealing ejection outlets for ejecting ink is applied to an orifice surface H1103 of the ink jet recording head H1001. The ink jet recording head unit H1002 has such a packing shape during transportation. The sealing tape H1401 is applied to the orifice surface H1003 so as to cover ejection outlets formed at the orifice surface H1003.

By the application of the sealing tape H1401, it is possible to not only protect the ejection outlets but also prevent ink leakage from the ejection outlets from occurring due to fluctuations in temperature and pressure during the transportation. Further, to the sealing tape H1401, a tag tape H1402 is provided for facilitating separation of the sealing tape H1401.

With reference to FIGS. 1A and 1B, the ink jet recording head H1001 will be described more specifically.

The ink jet recording head H1001 includes, as shown in FIG. 1A, an electric wiring tape H1301, an ink supply holding member H1501, a sealing member H1801, and a cap member H1901. The ink jet recording head H1001 further includes, as shown in FIG. 2, a recording element substrate H1101, ink absorbing members H1601, H1602 and H1603, and filters H1701, H1702 and H1703. The ink absorbing members H1601 to H1603 are not necessarily used.

The recording element substrate H1001 is formed by using an Si substrate in a thickness of 0.5 mm to 1 mm as a supporting member. The recording element substrate H1101 includes an electrode portion (not shown) for receiving an electric signal for ejecting the ink and ink supply ports (not shown) to which the ink in the ink container is to be supplied. The recording element substrate H1101 is provided with a nozzle layer having ejection outlets (not shown) for ejecting the ink onto the Si substrate.

The electric wiring tape H1301 is prepared by forming copper wiring on a polyimide film to ensure a path for applying an electric signal for ejecting the ink to the recording element substrate H1101. The electric wiring tape H1301 has an external signal input terminal H1302, an opening H1303, and an electrode terminal H1304.

The external signal input terminal H1302 is a terminal for receiving the electric signal from a main assembly of an apparatus (an ink jet recording apparatus).

The opening H1303 is used for incorporating therein the recording element substrate H1101.

The peripheral sealing material H1307 and the lead sealing material H1308 protect the recording element substrate H1101 and the electrode portion of the recording element substrate H1101 from the ink. The peripheral sealing material H1307 and the lead sealing material H1308 can be, e.g., a thermosetting epoxy sealing material, but may also be changed appropriately to other materials.

The ink supply holding member is formed, e.g., by resin molding and has an inner space for holding the ink absorbing members H1601 to H1603. Further, the ink supply holding member H1501 has an ink flow path through which the ink is supplied from each of the ink absorbing members H1601 to H1603 to the recording element substrate H1101.

At a downstream portion from the ink flow path of the ink supply holding member H1501, an ink supply port H1201 is formed. The recording element substrate H1101 is fixed so that the ink supply port provided to the Si substrate thereof can communicate with the ink supply port H1201 provided to the ink supply holding member H1501.

The ink absorbing members H1601 to H1603 are, e.g., a compressed member of polypropylene (PP) fibers but may also be appropriately changed to other materials.

Each of the ink absorbing members H1601 to H1603 generates a negative pressure to hold the ink. For example, the ink absorbing members H1601 to H1603 hold inks of cyan, magenta and yellow, respectively. These ink absorbing members H1601 to H1603 are inserted in predetermined positions in the inner space of the ink supply holding member H1501.

The filters H1701 to H1703 are used for preventing contaminations from entering the inside of the recording element substrate H1101. Each of the filters H1701 to H1703 is fixed at a boundary portion between the ink flow path of the ink supply holding member H1501 and each of the ink absorbing members H1601 to H1603.

The cap member H1901 is welded to an upper opening portion of the ink supply holding member H1501 in order to hermetically seal the inside of the ink supply holding member H1501.

However, the cap member 1901 is provided with small holes H1911 to H1913 for escaping pressures at respective portions of the inside of the ink supply holding member H1501. The cap member 1901 has minute grooves H1921 to H1923 for communicating the small holes H1911 to H1913 with each other.

The sealing member H1801 is bonded to the cap member H1901 so as to cover the small holes H1911 to H1913 and the minute grooves H1921 to H1923 except for one end portion of the minute groove H1923 opposite from the other portion of the minute groove H1923 communicating with the small hole H1913.

By this, the one end portion of the minute groove H1923 is opened, thus forming an ambient air communicating path through which each of the portions in the inner space communicate with ambient air.

The cap member H1901 is provided with an engaging portion H1930 for fixing the ink jet recording head H1001 to the apparatus main assembly.

The ink supply holding member H1501 and the cap member H1901 form a casing for an ink accommodating portion containing the ink absorbing members H1601 to H1603 and the filters H1701 to H1703.

Next, an ejection outlet surface (orifice surface) of the ink jet recording head used in the present invention will be described.

Figure 3A:
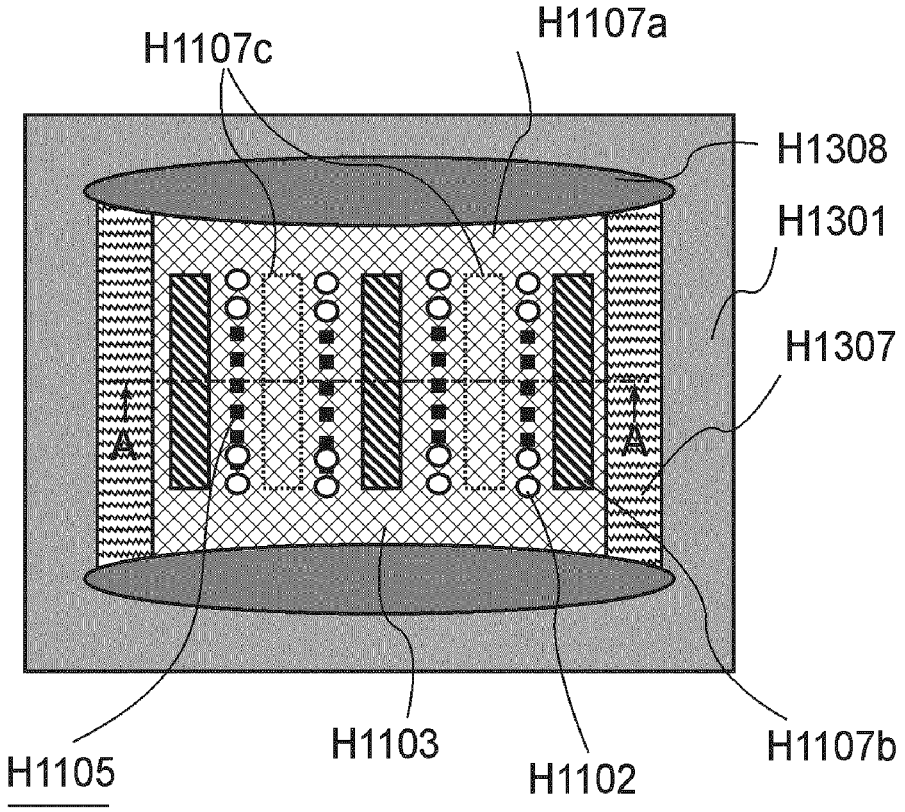
FIG. 3A is a schematic view showing an orifice surface of the ink jet recording head and heat generating elements appearing through partial projection of the orifice surface.

The ink jet recording head H1001 applicable to the present invention includes, as shown in FIG. 3A, an ejection outlet surface (orifice surface) H1103, the electric wiring tape H1301, the peripheral sealing material H1307, and the lead sealing material H1308.

Figure 3B:
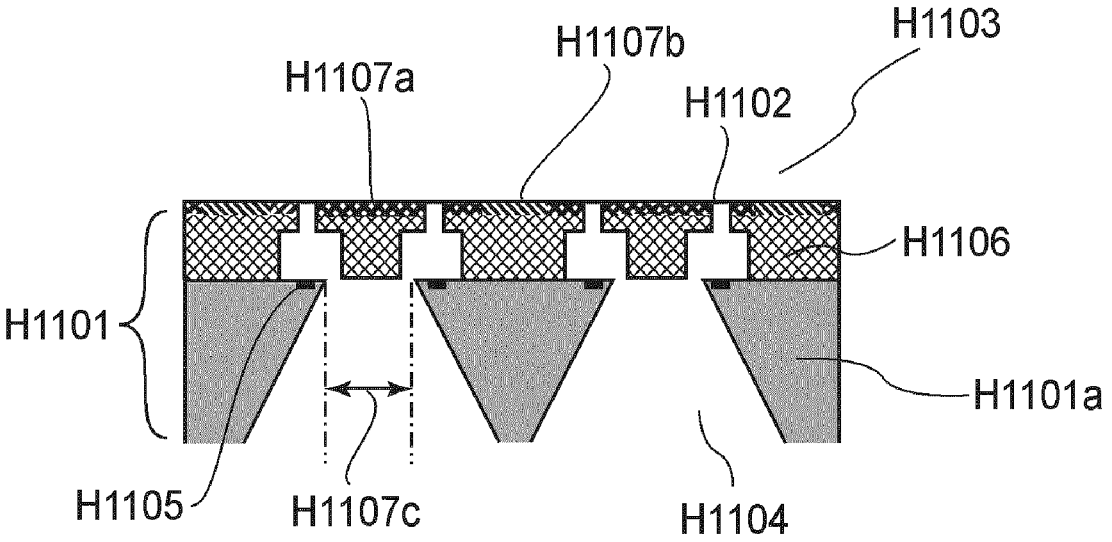
FIG. 3B is a schematic view showing A-A cross section at a central portion of the orifice surface shown in FIG. 3A.

As shown in FIG. 3B which is a sectional view taken along A-A line of FIG. 3A, the recording element substrate 1101 is constituted by an Si substrate H1101*a* and a nozzle layer H1106. To the Si substrate H1101*a*, heat generating elements H1105 and ink supply ports H1104 are provided. On the Si substrate, the nozzle layer H1106 provided with ejection outlets and ink flow paths is formed through photolithography or the like.

The orifice surface H1103 has a plurality of ejection outlets H1102 from which the ink is ejected. The ink flow path of the nozzle layer H1106 communicates with an ink supply port opening area H1107*c* as an opening of the ink supply port H1104. In the ink supply port opening area, the ink is supplied to the ejection outlet H1102 through the ink flow path of the nozzle layer H1106.

The orifice surface H1103 has a hydrophobic area 1107*a* with a relatively high hydrophobicity and a hydrophilic area H1107*b* with a relatively low hydrophobicity and is a surface to which the sealing tape H1401 is to be applied.

As shown in FIG. 3A, the hydrophobic area H1107*a* is formed at least in the neighborhood of the ejection outlets H1102 and has the function that the ink is less liable to remain in the neighborhood of the ejection outlets H1102. When the ink remains in the neighborhood of the ejection outlet H1102, there is a possibility that the remaining ink deposits on an edge of the ejection outlet H1102 or enters the ejection outlet H1102 to change an ejection direction of the ink during ink ejection thereby to adversely affect recording. For such a reason, at least in the neighborhood of the ejection outlets H1102, the hydrophobic area H1107*a* is provided.

The hydrophilic area H1107*b* is, as shown in FIG. 3A, formed in an elongated shape on the orifice surface H1103 at a portion apart from the ejection outlets H1102 along an arrangement direction of the ejection outlets H1102.

By forming the hydrophilic area H1107*b* in this manner, it is possible to move the ink deposited in the neighborhood of the ejection outlets H1102*a*, i.e., in the hydrophobic area H1107*a* toward the hydrophilic area H1107*b*, so that it is possible to reduce an amount of the ink remaining in the neighborhood of the ejection outlets H1102. Further, the hydrophilic area H1107*b* has the function of accumulating the ink moved from the ejection outlets H1102.

A method of forming the hydrophobic area H1107*a* and the hydrophilic area H1107*b* will be described. For example, the entire orifice surface H1103 on which the hydrophilic area H1107*b* has been formed in an entire area of the orifice surface H1103 is subjected to a hydrophobicity imparting (water repellent) treatment to form the hydrophobic area H1107*a*. Thereafter, a part of a surface of the hydrophobic area H1107*a* is removed by an excimer laser or the like to expose the hydrophilic area H1107*b*. In this manner, the hydrophobic area H1107*a* and the hydrophilic area H1107*b* can be formed. The method of forming the hydrophobic area H1107*a* and the hydrophilic area H1107*b* is not limited to the above method but may also be appropriately changed.

In order to reduce the amount of the ink remaining in the neighborhood of the ejection outlets H1102, an advancing contact angle with pure water in the hydrophobic area H1107*a* may desirably be a first value of 80 degrees to 105 degrees. Further, in order to further reduce the amount of the ink remaining at a periphery of the ejection outlets H1102 by forming the hydrophilic area H1107*b*, the advancing contact angle with pure water in the hydrophilic area H1107*b* may desirably be a second value less than the first value by 10 degrees or more.

In this embodiment, as the hydrophobicity-imparting treatment with respect to the orifice surface, a method using a fluorine-containing silane compound is employed and the advancing contact angle with water in the hydrophobic area H1107*a* is adjusted to 100 degrees. Further, the advancing contact angle with water in the hydrophilic area H1107*b* is adjusted to 70 degrees or less.

The present invention will be described based on specific embodiments.

Embodiment 1

Figure 4A:
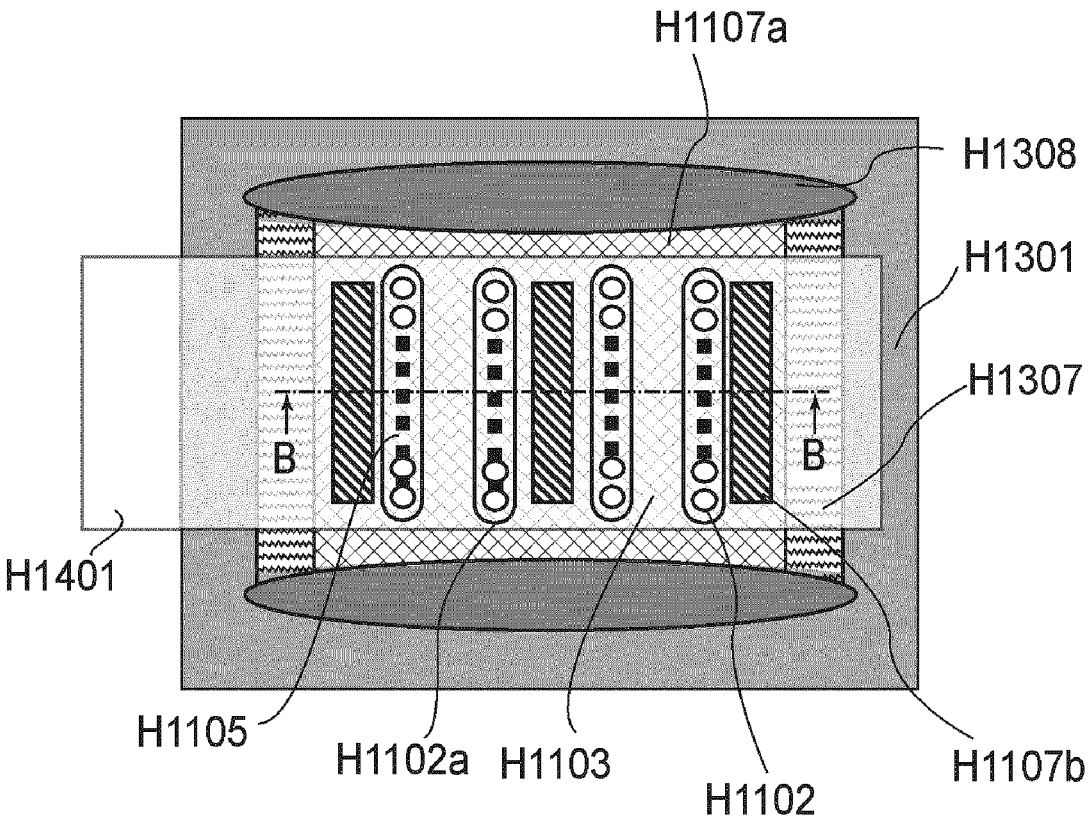
FIG. 4A is a schematic view showing an orifice surface of an ink jet recording head of Embodiment 1 as an embodiment of the present invention and heat generating elements appearing through partial projection of the orifice surface.
Figure 4B:
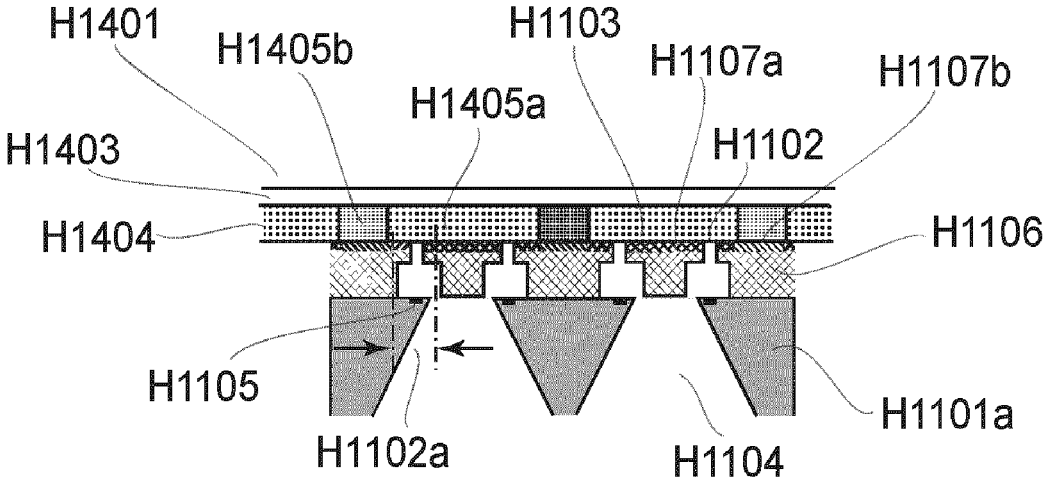
FIG. 4B is a schematic view showing B-B cross section at a central portion of the orifice surface shown in FIG. 4A.

With reference to FIGS. 4A and 4B, such a constitution that a sealing tape H1401 is applied to an orifice surface, of an ink jet recording head, having a hydrophobic area H1107*a* and a hydrophilic area H1107*b* will be described.

FIG. 4A shows the orifice surface, of the ink jet recording head described with reference to FIG. 3A, to which the sealing tape H1401 is applied. FIG. 4B is a sectional view taken along B-B line shown in FIG. 4A.

As shown in FIG. 4B, the sealing tape H1401 includes a sealing tape base material H1403 and an adhesive layer H1404 formed of an adhesive material.

The sealing tape base material H1403 may desirably have a thickness in a range from 7 μm to 75 μm, more desirably in a range from 12 μm to 30 μm. When the thickness of the sealing tape base material H1403 is in these ranges, an elasticity of the sealing tape H1401 can be considerably lowered. For that reason, even in the case where an unexpected impact is exerted on a portion where the sealing tape 1401 is not bonded to the orifice surface H1103, the impact can be alleviated by the portion. Therefore, it is possible to reduce a degree of the impact transmitted to an area in which the sealing tape H1401 and the orifice surface H1403 are bonded to each other, so that separation between the sealing tape H1401 and the orifice surface H1403 is less liable to occur.

The adhesive layer H1404 has a high adhesive force area H1405*a* and a low adhesive force area H1405*b*. A method of forming the high adhesive force area H1405*a* and the low adhesive force area H1405*b* will be described in detail later.

The high adhesive force area H1405*a* is a first area with a predetermined adhesive force and the low adhesive force area H1405*b* is a second area with an adhesive force lower than the predetermined adhesive force.

As shown in FIG. 4B, the sealing tape H1401 is applied to the orifice surface H1403 so that the high adhesive force area H1405*a* corresponds to the hydrophobic area H1107*a* and the low adhesive force area H1405*b* corresponds to the hydrophilic area H1107*b*.

As shown in FIGS. 4A and 4B, it is necessary to apply the sealing tape H1401 in the high adhesive force area H1405*a* to the orifice surface H1103 in an area H1102*a*, as the hydrophobic area, at a periphery of the ejection outlet H1102, in order to reduce a degree of ink leakage. The area H1102*a* at the periphery of the ejection outlet H1102 may have a width at least two times a diameter of the ejection outlet H1102.

By such a constitution, it is possible to reduce the amount of the residual ink in the ejection outlet H1102 by applying the sealing tape 1401 in the low adhesive force area H1405*b* to the orifice surface H1103 in the hydrophilic area H1107*b* while the degree of the ink leakage is reduced by sealing at least the area H1102*a* at the periphery of the ejection outlet H1102 with the high adhesive force area H1405*a* of the sealing tape H1401.

Figure 5:
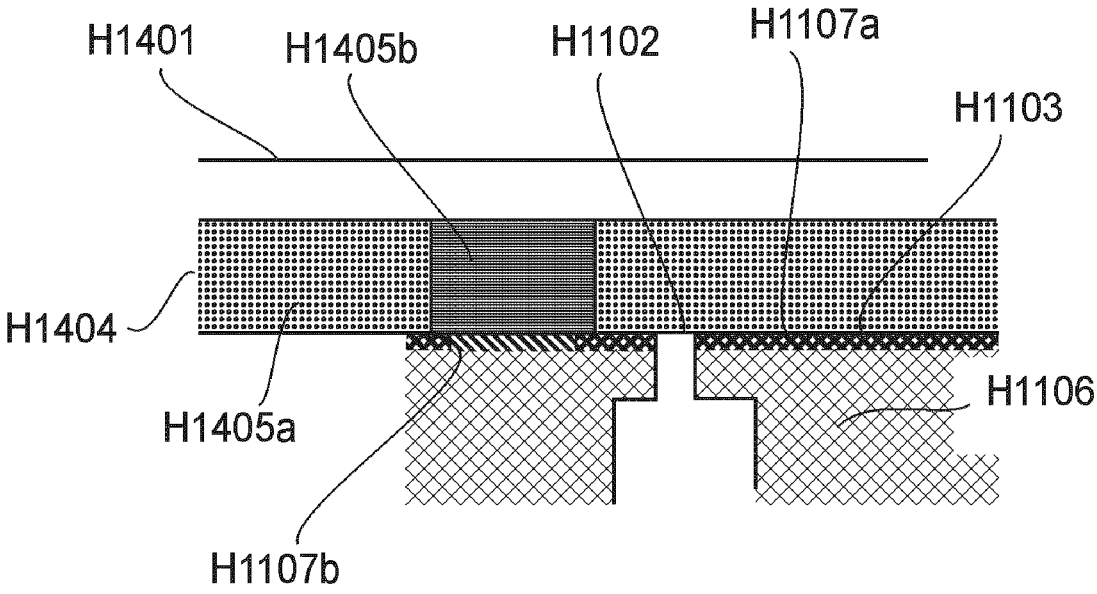
FIG. 5 is a schematic view for illustrating a positional relationship between a high adhesive area and a low adhesive area of a sealing tape and a positional relationship between a hydrophobic area and a hydrophilic area of an orifice surface.

Depending on the production processes of the present invention described later, the case where it is difficult to establish precise correspondence between the hydrophilic area H1107*b* and the low adhesive force area H1405*b* can be considered. Further, in the case where a part of the hydrophilic area H1107*b* and the high adhesive force area H1405*a* are applied to each other, there is a possibility that cohesive failure occurs in the adhesive layer when the sealing tape H1401 is separated from the orifice surface H1103 to result in the adhesive material remaining in the hydrophilic area H1107*b*. Therefore, as shown in FIG. 5, it is desirable that the low adhesive force area H1405*b* of the sealing tape H1401 is applied to the orifice surface H1101 so as to cover the hydrophilic area H1107*b*. That is, this state is such a state that the low adhesive force area H1405*b* having a larger area than that of the hydrophilic area H1107*b* is applied to the hydrophilic area H1107*b* so as to cover the hydrophilic area H1107*b*. By this application, even when a small amount of positional deviation between the applied hydrophilic area H1107*b* and low adhesive force area H1405*b* occurs, a possibility that the high adhesive force area H1405*a* is applied to the hydrophilic area H1107*b* can be decreased.

Figure 6:
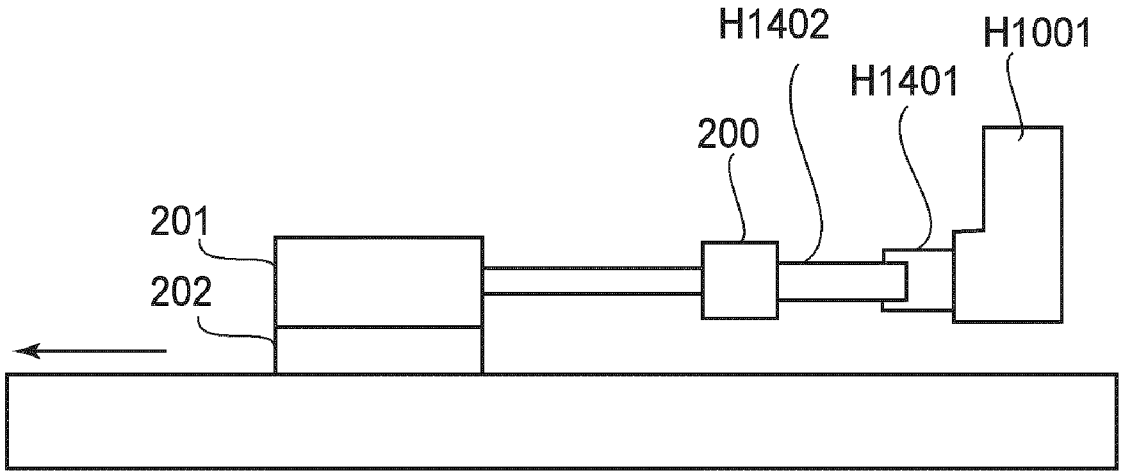
FIG. 6 is a schematic view showing a general structure of a separation force measuring apparatus.

A method of measuring a separation force required for separating the sealing tape H1401 from the orifice surface H1103 in the present invention will be described. FIG. 6 is a measuring apparatus used in the present invention.

A measuring sample (ink jet recording head) H1001 to which the sealing tape H1401 is applied is prepared and a portion of the tag tape H1402 of the sealing tape H1401 is attached to a clamp 200. The clamp 200 is connected to a push pull gauge 201 attached to a stage 202. The stage 202 is moved in a separating direction of the sealing tape H1401 to separate the sealing tape H1401 from the measuring sample H1001. The separation force is determined by a reading of the push pull gauge at this time.

A value of the separation force measured by the above-described method is a larger value of values of the separation force in the high adhesive force area H1405*a* applied to the hydrophobic area H1107*a* and the separation force in the low adhesive force area H1405*b* applied to the hydrophilic area H1107*b*. With respect to the separation force, it is desirable that the separation force in the high adhesive force area H1405*a* applied to the hydrophobic area H1107*a* is larger than the separation force in the low adhesive force area H1405*b* applied to the hydrophilic area H1107*b*.

When the separation force between the orifice surface H1103 and the sealing tape H1401 in this embodiment was measured by the above-described method, the separation force corresponded to the separation force in the high adhesive force area H1405*a* applied to the hydrophobic area H1107*a* and was in a range of 10N/m or more to 40 N/m or less when a separating speed was 200 mm/min.

In the case where the separation force was measured by the above-described method when an entire area of the orifice surface is the hydrophilic area and an entire area of the sealing tape is the low adhesive force area, the measured separation force was in a range of 1 N/m or more to 10 N/m or less when the separating speed was 200 mm/min.

Figure 7A:
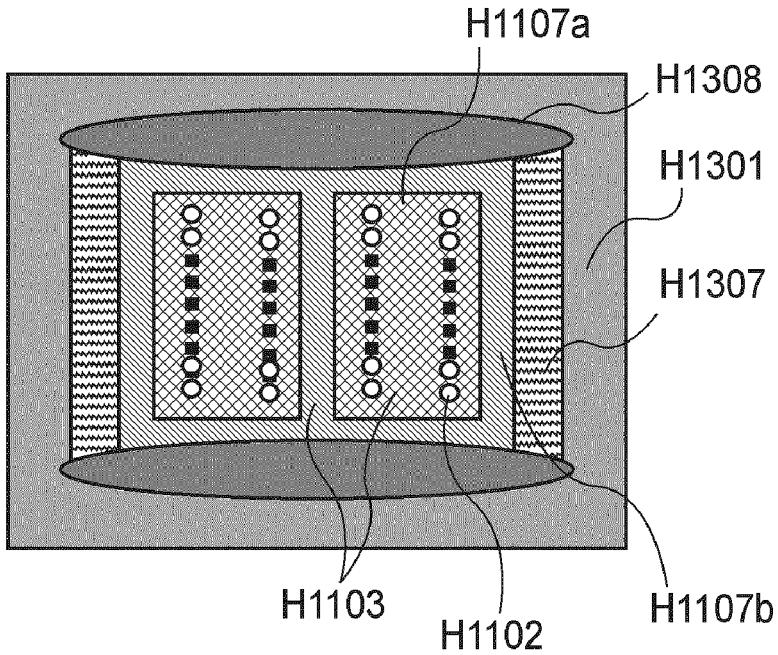
FIG. 7A and FIG. 7B are schematic views each showing an example of a shape of the hydrophobic area and a shape of the hydrophilic area of the orifice surface.
Figure 7B:
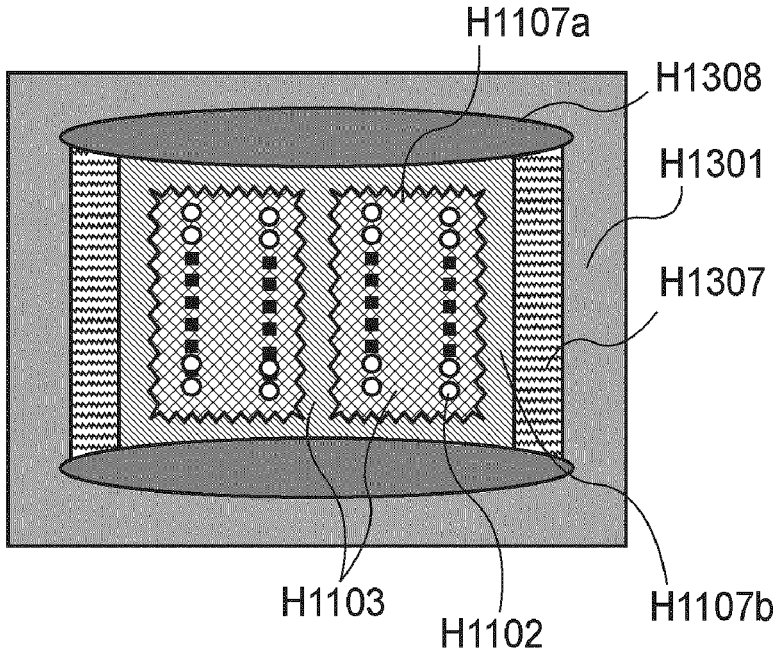

Next, shapes of the hydrophobic area H1107*a* and the hydrophilic area H1107*b* of the orifice surface H1103 will be described. FIGS. 7A and 7B show the shapes of the hydrophobic area and the hydrophilic area of the orifice surface different from those shown in FIG. 3A.

In FIGS. 7A and 7B, the hydrophobic area H1107*a* is formed on the orifice surface H1103 in the neighborhood of the ejection outlets H1102 similarly as in the case of that shown in FIG. 3A.

A boundary between the hydrophobic area H1107*a* and the hydrophilic area H1107*b* is a line shape in FIG. 7A but is a sawtooth shape in FIG. 7B.

Further, a total area of the hydrophobic area H1107*a* and the hydrophilic area H1107*b* shown in each of FIGS. 7A and 7B is larger than that shown in FIG. 3A. For this reason, the ink jet recording heads H1001 shown in FIGS. 7A and 7B have an amount of ink, storable in the hydrophilic area H1107*b*, larger than that in the case of the ink jet recording head H1001 shown in FIG. 3A. Therefore, the ink jet recording heads H1001 shown in FIGS. 7A and 7B are suitable as an elongated ink jet recording head with an amount of ink usage.

Such an ink jet recording head has a larger hydrophilic area H1107*b*, so that it can be said that the remaining adhesive material is liable to occur unless the present invention is applied to the ink jet recording head. However, by applying the present invention to the ink jet recording head, it is possible to provide an ink jet recording head which achieves such an effect that the adhesive material is less liable to remain and an amount of ink storable on the orifice surface when the sealing tape is separated from the orifice surface at the time of use can be minimized.

The shape of the hydrophilic area H1107*b* is not limited to those shown in FIGS. 3A, 7A and 7B but may also be appropriately changed.

As a result of evaluation of the ink jet recording head unit of this embodiment, separation of the sealing tape and ink leakage did not occur during conveyance. Further, when the sealing tape was separated at the time of use, breaking of the orifice surface H1103 and the remaining adhesive material did not occur.

According to this embodiment, it is possible to alleviate excessive adhesiveness of the adhesive material to the hydrophilic area H1107*b* during the separation of the sealing tape, thus resulting in a decreased amount of the remaining adhesive material.

Embodiment 2

Figure 8A:
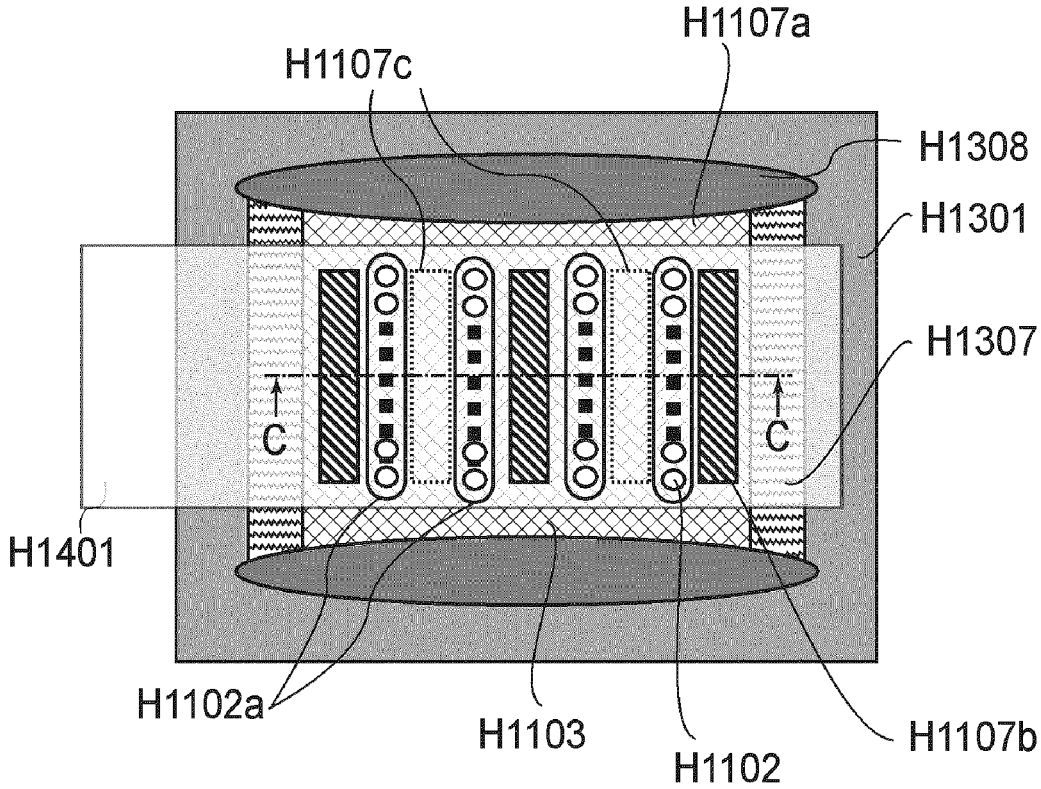
FIG. 8A is a schematic view showing an orifice surface of an ink jet recording head of Embodiment 2 as an embodiment of the present invention and heat generating elements appearing through partial projection of the orifice surface.
Figure 8B:
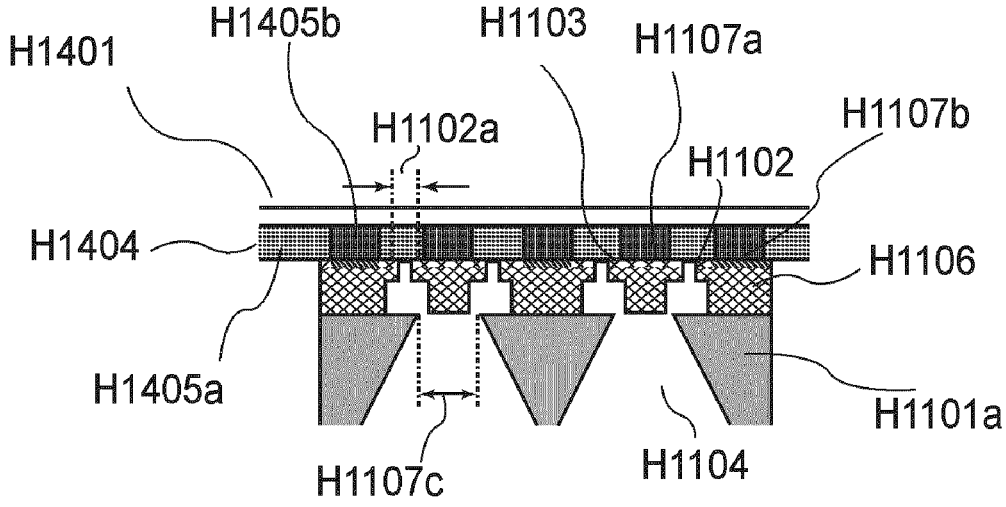
FIG. 8B is a schematic view showing C-C cross section at a central portion of the orifice surface shown in FIG. 8A.

FIG. 8A is a schematic view for illustrating a positional relationship between the ink supply port opening area H1107*c* and the orifice surface H1103 of an ink jet recording head in this embodiment. FIG. 8B is a schematic view showing a C-C cross section at a central portion of the orifice surface H1103 shown in FIG. 8A.

In this embodiment, in addition to the constitution of Embodiment 1, the adhesive force of the sealing tape at a portion corresponding to the ink supply port opening area H1107*c* in the hydrophobic area H1107*a* is decreased.

As shown in FIG. 8B, the ink supply port opening area H1107*c* is an area in which the Si substrate H1101*a* is provided with an opening facing the nozzle layer H1106. In this embodiment, the ink supply port H1104 is common to two ejection outlet arrays adjacent to the ink supply port H1104 on both sides thereof and supplies the ink to the ejection outlet arrays.

Due to such a constitution, a portion of the nozzle layer H1106 facing the ink supply port opening area H1107*c* is liable to be deformed or broken at the orifice surface H1103 when the sealing tape H1401 is separated from the orifice surface H1103. Therefore, it is desirable that the sealing tape H1401 is applied to the orifice surface H1103 so that an adhesive layer with the low adhesive force (the low adhesive force area H1405*b*) corresponds to a portion, of the orifice surface H1103, located opposite to the ink supply port opening area H1107*c*.

However, as described with reference to FIG. 4B, it is necessary to apply the sealing tape H1401 to the orifice surface H1103 so that the adhesive layer with the high adhesive force corresponds to the area H1102*a* at the periphery of the ejection outlet of the orifice surface H1103 from the viewpoint of prevention of the ink leakage.

Accordingly, as shown in FIG. 8B, the sealing tape H1401 is applied to the orifice surface H1103 so that the low adhesive force adhesive layer corresponds to an area, other than the area H1102*a* at the periphery of the ejection outlet, of the area opposite to the ink supply port opening area H1107*c* of the orifice surface H1103, with the result that it is possible to decrease the degree of deformation or breaking of the orifice surface H1103.

In this embodiment, the adhesive forces of the sealing tape H1401 in the low adhesive force area H1405*b* applied to the hydrophilic area H1107*b* and the ink supply port opening area H1107*c* are equal to each other. However, these adhesive forces may also be different from each other. It is desirable that the adhesive force of the sealing tape H1401 applied to the ink supply port opening area H1107*c* is smaller than that of the sealing tape applied to the hydrophilic area H1107*b*.

By employing the constitution of the sealing tape as described above, it is possible to decrease the amount of the remaining adhesive material while the degrees of ink leakage, and deformation or breaking of the orifice surface are decreased.

Embodiment 3

In Embodiment 3 and subsequent embodiments, a process for producing the ink jet recording head unit of the present invention will be described.

In this embodiment, as the adhesive layer of the sealing tape H1401, an ultraviolet (UV)-curable adhesive layer is used. The UV-curable adhesive layer has a property of being cured by irradiation with UV rays to be lowered in adhesiveness.

As the sealing tape base material H1403, it is desirable that a material having a high transparency to the UV rays is used and, e.g., a resin film may be used. When the resin film having the high transparency is used, it is possible to cure the adhesive layer H1404 by irradiating the adhesive layer 1404 with the UV rays via the resinous film. Examples of the resin film having such a property may include polyolefin resin films such as a polypropylene film and a polyethylene film.

A surface of the sealing tape H1403 on which the adhesive layer H1404 is to be provided may be subjected to surface treatment such as plasma treatment or corona discharge treatment in order to improve the adhesiveness of the adhesive layer.

The adhesive layer H1404 is, e.g., constituted by an acrylic adhesive polymer, an UV-curable oligomer and a photoinitiator. The UV-curable oligomer principally comprises, e.g., polyester, epoxy and urethane but the composition thereof may also be changed appropriately.

Examples of the photoinitiator may include α-allylbenzoin, α-allylbenzoin aryl ether, an acrylated benzophenone compound, 1-hydroxycyclohexyl phenyl ketone, and 4-(2-acryloxyethoxy)phenyl-2-hydroxy-2-propyl ketone. The photoinitiator is not limited thereto but may also be appropriately changed.

The adhesive layer H1404 may have a thickness in a range from 5 μm to 50 μm, desirably in a range from 10 μm to 40 μm. In a state in which the adhesive layer has a thickness of less than 5 μm, an effect of generating the adhesive force by flexibility of the adhesive layer H1404 is lowered and for this reason, the thickness of the adhesive layer H1404 may desirably have a lower limit of 5 μm. On the other hand, above 50 μm, the effect of generating the adhesive force by flexibility is not so changed, so that an upper limit of the thickness of the adhesive layer H1404 may be about 50 μm from the viewpoint of cost.

Figure 9A:
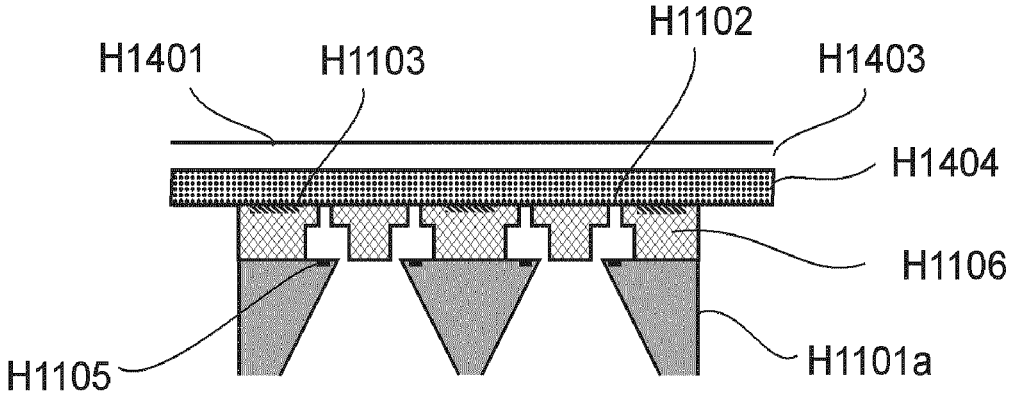
FIGS. 9A, 9B and 9C are schematic views showing process steps in Embodiment 3 for illustrating a production process of the present invention.
Figure 9B:
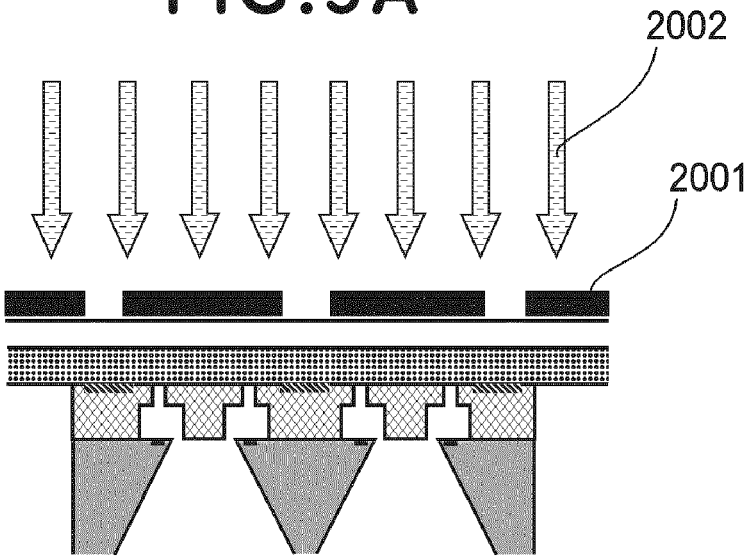
Figure 9C:
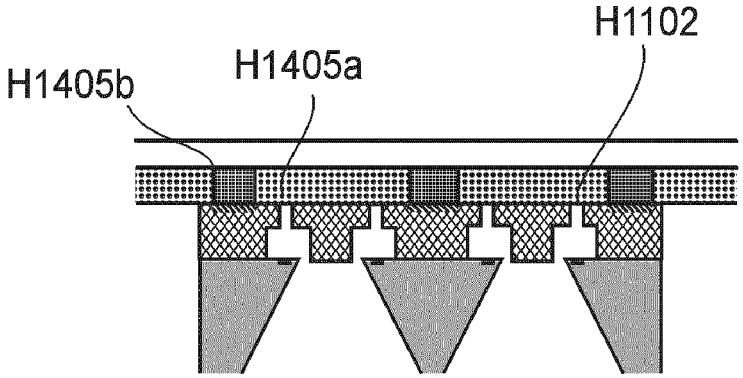

FIGS. 9A to 9C show process steps for applying the sealing tape 1401 to the ink jet recording head H1001 in this embodiment.

Step of FIG. 9A: A sealing tape H1401 having a predetermined adhesive force is applied to an orifice surface H1103 having a hydrophobic area H1107*a* and a hydrophilic area H1107*b*.

Step of FIG. 9B: Next, a mask 2001 for masking areas other than an area corresponding to the hydrophilic area H1107*b* is disposed on a sealing tape base material H1403 side and thereafter an adhesive layer H1404 of the sealing tape H1401 is irradiated with UV rays 2002.

Step of FIG. 9C: The sealing tape H1401 is adhered to the ink jet recording head with an adhesive force, of an adhesive material for the adhesive layer H1404, which is lowered in the area irradiated with the UV rays 2002. In this case, the UV rays 2002 are absorbed by the adhesive layer H1404, so that the UV rays 2002 do not reach the orifice surface H1103.

Through the above-described steps, it is possible to prepare the ink jet recording head unit of the present invention.

As described above, after the sealing tape H1401 is applied to the orifice surface H1103, the adhesive layer is irradiated with the UV rays using the mask 2001, so that it is possible to easily position the irradiation area by the UV rays 2002.

However, it can be considered that it is difficult to set the UV irradiation area with respect to the low adhesive force area H1405 with accuracy so that the low adhesive force area H1405 precisely corresponds to the hydrophilic area H1107*b*. In such a case, as described in Embodiment 1 with reference to FIG. 5, the low adhesive force area H1405*b* may be applied to the hydrophilic area H1107*b* so as to cover the hydrophilic area H1107*b*. That is, in the step shown in FIG. 9B, an area which includes and somewhat larger than the portion corresponding to the hydrophilic area H1107*b* may be irradiated with the UV rays 2002.

However, it can be considered that it is difficult to set the UV irradiation area with respect to the low adhesive force area H1405 with accuracy so that the low adhesive force area H1405 precisely corresponds to the hydrophilic area H1107*b*. In such a case, as described in Embodiment 1 with reference to FIG. 5, the low adhesive force area H1405*b* may be applied to the hydrophilic area H1107*b* so as to cover the hydrophilic area H1107*b*. That is, in the step shown in FIG. 9B, an area which includes and is somewhat larger than the portion corresponding to the hydrophilic area H1107*b* may be irradiated with the UV rays 2002.

By employing such a constitution, it is possible to reduce a possibility that the high adhesive force area H1405*a* is applied to the hydrophilic area H1107*b* by deviation of the UV irradiation area. Accordingly, it is possible to achieve an effect of decreasing a degree of an occurrence of the adhesive material remaining in the hydrophilic area H1107*b* by a drop of the adhesive material from the adhesive layer H1404 of the sealing tape 1401 during the separation of the sealing tape 1401.

Embodiment 4

In the production steps described in Embodiment 3, the state in which the adhesive layer 1404 is irradiated with the UV rays 2002 through the sealing tape base material H1403 is described. However, in the case where the sealing tape base material H1403 has a low transparency to the UV rays 2002, in the production steps described in Embodiment 3, it is difficult to change the adhesive force of the adhesive layer H1404 depending on the areas.

FIGS. 10A to 10D show production steps for applying the sealing tape H1401 to the ink jet recording head H1001 in the case where the sealing tape base material H1403 has the low transparency to the UV rays 2002. The constitution similar to that in Embodiment 3 will be omitted from explanation.

Figure 10A:
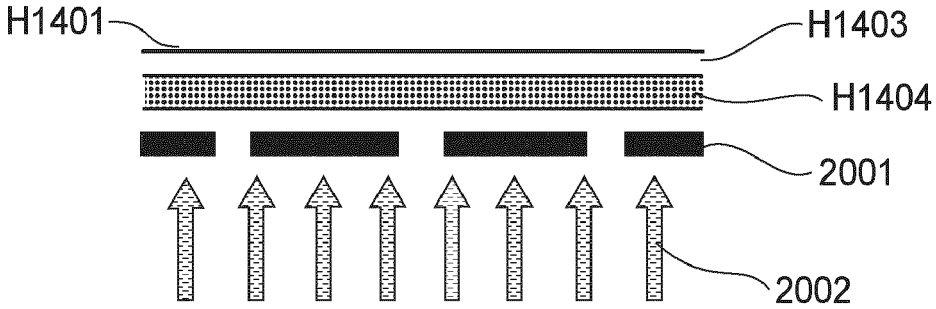
FIGS. 10A, 10B, 10C and 10D are schematic views showing process steps in Embodiment 4 for illustrating a production process of the present invention.

Step of FIG. 10A: A mask 2001 for masking areas other than an area corresponding to the hydrophilic area H1107*b* is disposed on an adhesive layer H1404 side and thereafter the adhesive layer H1404 of the sealing tape H1401 is irradiated with UV rays 2002.

Figure 10B:
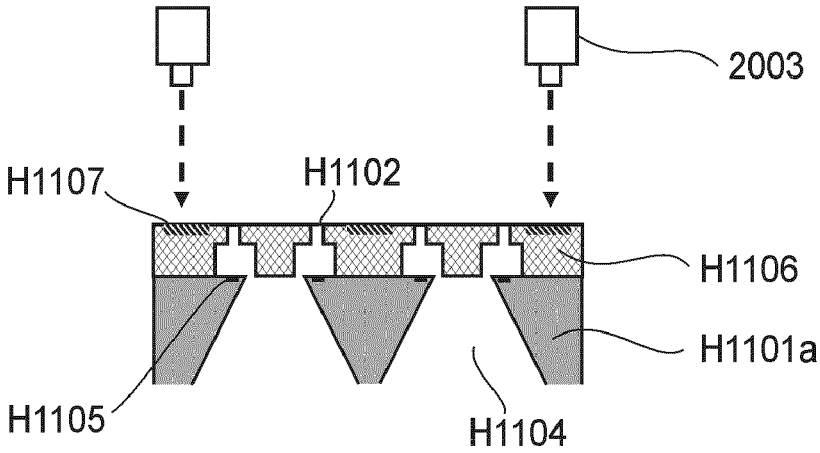

Step of FIG. 10B: A position of the hydrophilic area H1107*b* or a separately provided alignment mark (not shown) of the ink jet recording head H1001 is identified by a camera 2003.

Figure 10C:
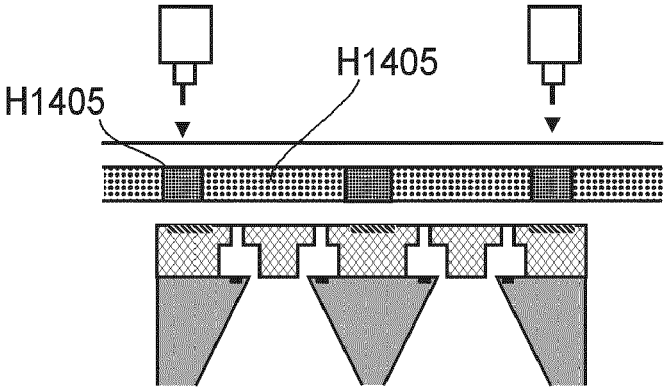

Step of FIG. 10C: Between the ink jet recording head H1001 and the camera 2003, the sealing tape H1401 is disposed. A position of the low adhesive force area H1405*b* of the sealing tape H1401 or an area (not shown) corresponding to the alignment mark of the ink jet recording head H1001 is identified by the camera 2003.

Figure 10D:
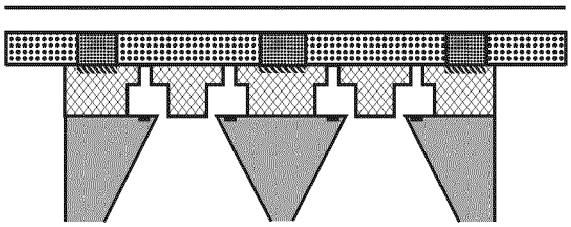

Step of FIG. 10D: To the thus positioned orifice surface having the hydrophobic area H1107*a* and the hydrophilic area H1107*b* of the ink jet recording head H1001, the sealing tape H1401 is applied.

Through the above-described steps, it is possible to prepare the ink jet recording head unit of the present invention.

However, in this embodiment, it is difficult to provide the low adhesive force area H1405 so as to correspond to the hydrophilic area H1107*b* by completely positioning the orifice surface to an extent exceeding that in Embodiment 3.

Therefore, as shown in FIG. 5A, the area of the low adhesive force area H1405*b* may be constituted to be larger than at least the area of the hydrophilic area H1107*b* so as to cover the hydrophilic area H1107*b*.

By employing such a constitution, it is possible to reduce a possibility that the high adhesive force area H1405*a* is applied to the hydrophilic area H1107*b* by deviation of the positioning. Accordingly, it is possible to achieve an effect of decreasing a degree of an occurrence of the adhesive material remaining in the hydrophilic area H1107*b* by a drop of the adhesive material from the adhesive layer H1404 of the sealing tape 1401 during the separation of the sealing tape 1401.

Further, according to the production process of this embodiment, the sealing tape base material H1403 is not required to have the transparency to the UV rays.

Embodiment 5

In this embodiment, as the method of imparting the desired adhesive force to the predetermined area of the adhesive layer of the sealing tape, a method different from the method using the UV-curable adhesive layer described in Embodiment 3 and Embodiment 4 will be described. The constitution similar to that described in Embodiment 3 and Embodiment 4 will be omitted from explanation.

In this embodiment, a sealing tape such that the adhesive force in a heated area is lowered is employed.

A sealing tape H2401 has an adhesive layer H2404 containing thermal expansive microspheres. The thermal expansive microspheres are prepared by incorporating a substance which is easily gasified and expanded by heating into an elastic shell.

Examples of the substance may include isobutane, propane, pentane, etc.

The elastic shell may desirably be formed of a heat-fusible substance or a substance which is broken by thermal expansion. By using such a material, when a desired area of the sealing tape H2401 is heated, the thermal expansive microspheres in the heated adhesive layer H2404 are expanded. As a result, a contact area between the orifice surface and the adhesive material is decreased, so that the adhesive force can be lowered.

Examples of the substance forming the elastic shell may include vinylidene chloride-acrylonitrile copolymer, polyvinyl alcohol, polyvinyl butyral, polymethyl methacrylate, polyacrylonitrile, polysulfone, etc.

Figure 11A:
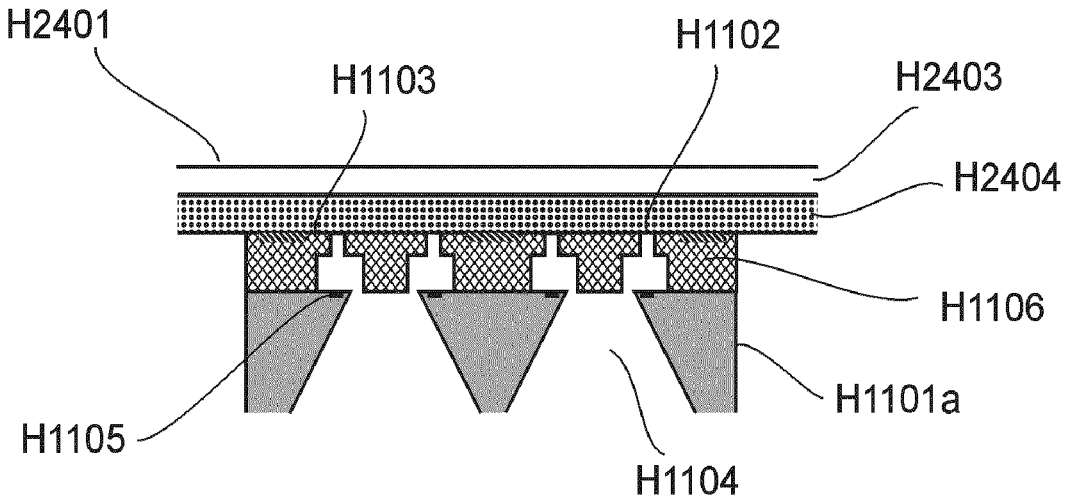
FIGS. 11A, 11B and 11C are schematic views showing process steps in Embodiment 5 for illustrating a production process of the present invention.
Figure 11B:
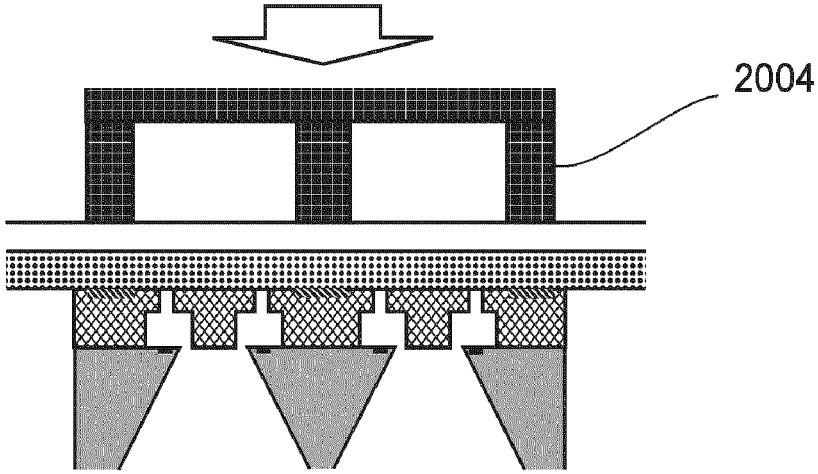
Figure 11C:
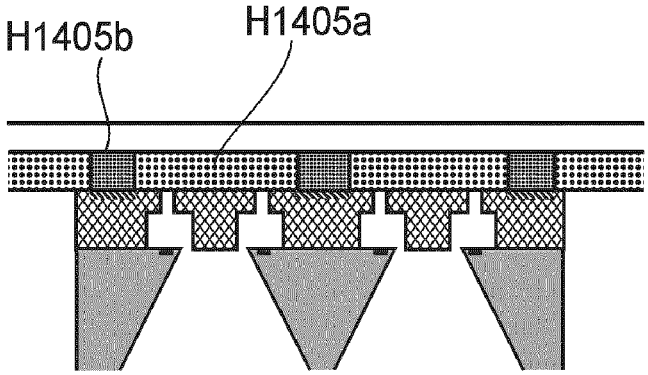

FIGS. 11A to 11C show process steps for applying the sealing tape 2401 to the ink jet recording head H1001 in this embodiment.

Step of FIG. 11A: A sealing tape H2401 comprising an acrylic adhesive material and thermal expansive microspheres contained in the adhesive material is applied to an orifice surface H1103 having a hydrophobic area H1107*a* and a hydrophilic area H1107*b*.

Step of FIG. 11B: A heated horn 2004 is applied to an area corresponding to the hydrophilic area H1107*b* of the sealing tape H2401. In this step, in the heated area of the sealing tape H2401, the thermal expansive microspheres in the adhesive layer H2404 are expanded to decrease the contact area between the orifice surface and the adhesive material, thus lowering the adhesive force. The heating by the horn 2004 is performed at about 90° C. to about 170° C.

Step of FIG. 11C: FIG. 11C shows a state in which the sealing tape H2401 as applied to the orifice surface has the low adhesive force area H1405*a* of the adhesive layer H2404 corresponding to the hydrophilic area H1107*b* of the orifice surface.

Through the above-described steps, it is possible to prepare the ink jet recording head unit of the present invention.

Also in this embodiment, similarly as in Embodiment 3 and Embodiment 4, an effect similar to that in Embodiment 3 and Embodiment 4 can be achieved by employing the constitution shown in FIG. 5.

As a material for a sealing tape base material H2403, from the viewpoints of an affinity for the adhesive material, heat-resistivity, and a distributability in the market, it is desirable that a polyester resin is used.

In Embodiments 3 to 5 described above, the shapes of the high adhesive force area and the low adhesive force area of the sealing tape are described as an example. However, by appropriately changing the shapes of the mask and the horn, the constitutions of Embodiments 3 to 5 may also be applicable to the shapes of the high and low adhesive force areas of the sealing tape described in Embodiment 2.

In Embodiments 3 to 5, as the adhesive layer H1404, the UV-curable adhesive layer or the adhesive layer lowering in adhesive force in the heated area is used but any adhesive layer may also be used so long as the adhesive layer is capable of changing its adhesiveness by imparting energy to the adhesive layer.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 180795/2007 filed Jul. 10, 2007 and No. 124927/2008 filed May 12, 2008, which are hereby incorporated by reference herein.

What is claimed is:

1. An ink jet recording head unit comprising:

an ink jet recording head having an ejection outlet surface in which a plurality of ejection outlets for ejecting ink is formed, the ejection outlet surface having a first area, at a periphery of the ejection outlets, which has a contact angle with water of a first value and a second area which has a contact angle with water of a second value that is less than the first value; and a tape applied to the ejection outlet surface so as to seal the ejection outlets, said tape having a first portion and a second portion which has an adhesiveness less than that of the first portion, wherein the tape is applied to the ejection outlet surface so that the first portion corresponds to at least the first area at the periphery of the ejection outlets and the second portion corresponds to the second area in which the contact angle with water is the second value.

2. A head according to claim 1, wherein the second portion of said tape has an area substantially equal to that of the second area of the ejection outlet surface in which the contact angle with water is the second value.

3. A head according to claim 1, wherein the second portion of said tape has an area larger than that of the second area of the ejection outlet surface in which the contact angle with water is the second value.

4. A head according to claim 1, further comprising an ink supply port and a plurality of ejection outlet arrays adjacent to said ink supply port on both sides of said ink supply port, wherein said ink supply port has an opening communicating with the plurality of ejection outlets constituting the plurality of ejection outlet arrays, and wherein said tape further has a third portion, which has an adhesiveness less than that of the first portion, applied to the ejection outlet surface so as to correspond to an area, other than the first area at the periphery of the ejection outlets, between the plurality of ejection outlet arrays.

5. A head according to claim 4, wherein the second portion and the third portion of said tape have the substantially same adhesiveness.

6. A head according to claim 4, wherein the third portion of said tape has an adhesiveness less than that of the second portion of said tape.

7. A head according to claim 1, wherein a separation force between said tape and the ejection outlet surface is 10 N/m or more and 40 N/m or less when a separation speed is 200 mm/min.

8. A process for producing an ink jet recording head unit, comprising:

preparing an ink jet recording head having an ejection outlet surface in which a plurality of ejection outlets for ejecting ink is formed, the ejection outlet surface having a first area, at a periphery of the ejection outlets, which has a contact angle with water of a first value and a second area which has a contact angle with water of a second value less than the first value;

applying onto the ejection outlet surface a tape changeable in adhesiveness by imparting energy to the tape; and imparting energy to the tape so that the adhesiveness of a second portion of the tape corresponding to the second area of the ejection outlet surface in which the contact angle with water is the second value is less than that of a first portion of the tape corresponding to at least the first area of the ejection outlet surface at the periphery of the ejection outlets.

9. A process for producing an ink jet recording head unit, comprising:

preparing an ink jet recording head having an ejection outlet surface onto which a tape changeable in adhesiveness by imparting energy to the tape is applied and in which a plurality of ejection outlets for ejecting ink is formed, the ejection outlet surface having a first area, at a periphery of the ejection outlets, which has a contact angle with water of a first value and a second area which has a contact angle with water of a second value less than the first value; and imparting energy to the tape so that the adhesiveness of a second portion of the tape corresponding to the second area of the ejection outlet surface in which the contact angle with water is the second value is less than that of a first portion of the tape corresponding to at least the first area of the ejection outlet surface at the periphery of the ejection outlets.

10. A process for producing an ink jet recording head unit, comprising:

preparing an ink jet recording head having an ejection outlet surface in which a plurality of ejection outlets for ejecting ink is formed, the ejection outlet surface having a first area, at a periphery of the ejection outlets, which has a contact angle with water of a first value and a second area which has a contact angle with water of a second value less than the first value;

imparting energy to a tape changeable in adhesiveness by imparting energy to the tape so that the adhesiveness of a predetermined second portion of the tape is less than that of a predetermined first portion of the tape; and applying, onto the ejection outlet surface, the tape so that the predetermined first portion of the tape corresponds to the first area of the ejection outlet surface at the periphery of the ejection outlets and the predetermined second portion of the tape corresponds to the second area of the ejection outlet surface in which the contact angle with water is the second value.

11. A process according to claim 8, wherein the ink jet recording head unit further comprises an ink supply port having an opening and a plurality of ejection outlet arrays adjacent to the ink supply port on both sides of the ink supply port, the plurality of ejection outlet arrays comprising the plurality of ejection outlets communicating with the opening of the ink supply port, said process further comprising:

imparting energy to the tape so that a predetermined third portion of the tape corresponding to an area, other than the second area of the ejection outlet surface at the periphery of the ejection outlets, between the plurality of ejection outlet arrays has an adhesiveness less than that of the predetermined first portion of the tape corresponding to at least the first area of the ejection outlet surface at the periphery of the ejection outlets.

12. A process according to claim 8, wherein the energy is imparted to the tape by irradiating the tape with ultraviolet rays to lower the adhesiveness of the tape.

13. A process according to claim 8, wherein the energy is imparted to the tape by heating the tape to lower the adhesiveness of the tape.

* * * * *